US005626154A

United States Patent [19]

Rogers et al.

[11] Patent Number: 5,626,154

[45] Date of Patent: May 6, 1997

[54] METHOD AND SYSTEM FOR SHAVING INCLUDING A LUBRICANT AND A WATER-SWELLABLE POLYMER

[75] Inventors: Brian A. Rogers, Boston; Frank E. Badin, Scituate; James A. Rudolph, Stoneham; Mingchih M. Tseng, Hingham, all of Mass.

[73] Assignee: The Gillette Company, Boston, Mass.

[21] Appl. No.: 121,153

[22] Filed: Sep. 13, 1993

[51] Int. Cl.[6] ..... B26B 21/44

[52] U.S. Cl. ..... 132/200; 30/41; 83/22; 424/73

[58] Field of Search ..... 30/41, 50, 90, 30/32, 40, 84; 83/14, 22; 424/73; 132/200

[56] References Cited

U.S. PATENT DOCUMENTS

| | | | |
|---|---|---|---|
| 2,183,554 | 12/1939 | Evans . | |
| 2,292,418 | 8/1942 | Wetherbee . | |
| 2,292,419 | 8/1942 | Wetherbee . | |
| 2,365,444 | 12/1944 | Babenco . | |
| 3,758,161 | 9/1973 | Bradley et al. . | |
| 3,811,349 | 5/1974 | Jennings . | |
| 3,879,844 | 4/1975 | Griffiths | 30/41.7 |
| 3,956,951 | 5/1976 | Jennings, Sr. . | |
| 4,047,296 | 9/1977 | Ishida et al. . | |
| 4,170,821 | 10/1979 | Booth . | |
| 4,381,293 | 4/1983 | Michel . | |
| 4,501,834 | 2/1985 | Su . | |
| 4,586,255 | 5/1986 | Jacobson . | |
| 4,624,051 | 11/1986 | Apprille, Jr. et al. . | |
| 4,850,106 | 7/1989 | Braun et al. . | |
| 4,858,314 | 8/1989 | Cunningham . | |
| 4,872,263 | 10/1989 | Etheredge, III . | |
| 4,875,287 | 10/1989 | Creasy et al. . | |
| 4,902,565 | 2/1990 | Brook . | |
| 4,954,337 | 9/1990 | Gripp et al. . | |
| 4,996,772 | 3/1991 | Iten | 30/41 |
| 5,005,287 | 4/1991 | Ritter | 30/41 |
| 5,056,221 | 10/1991 | Thoene | 30/50 X |
| 5,056,222 | 10/1991 | Miller et al. | 30/41 X |
| 5,095,619 | 3/1992 | Davis et al. . | |
| 5,095,620 | 3/1992 | Althaus . | |
| 5,113,585 | 5/1992 | Rogers et al. . | |
| 5,345,680 | 9/1994 | Vreeland et al. | 30/90 X |
| 5,349,750 | 9/1994 | Tseng | 30/41 |
| 5,454,164 | 10/1995 | Yin et al. | 30/41 |

FOREIGN PATENT DOCUMENTS

| | | |
|---|---|---|
| 2024082 | 1/1980 | United Kingdom . |

OTHER PUBLICATIONS

Stockhausen, Favor Absorbent Polymer Applications, 1992.

Allied Colloids, Superabsorbent Polymer Designed for Rapid Uptake and Retention of Body Fluids.

Hoechst Celanese, Sanwet IM-1000 Superabsorbent Polymer, 1988.

*Primary Examiner*—Rinaldi I. Rada
*Assistant Examiner*—Clark F. Dexter
*Attorney, Agent, or Firm*—Fish & Richardson P.C.

[57] ABSTRACT

A shaving unit includes a composite that has a surface for engaging the user's skin. The composite contains a water-insoluble polymer, a shaving aid in the form of a lubricant, and a water-swellable polymer which, upon contact with water, enhances the release of the lubricant from the composite onto the skin.

26 Claims, 1 Drawing Sheet

METHOD AND SYSTEM FOR SHAVING INCLUDING A LUBRICANT AND A WATER-SWELLABLE POLYMER

This invention relates to shaving systems.

In shaving systems of the wet shave type, factors such as the frictional drag of the razor across the skin, the force needed to sever hairs, and irritation of preexisting skin damage can create a degree of shaving discomfort. Discomfort and other problems accompanying wet shaving systems can be alleviated by the application of shaving aids to the skin. Shaving aids may be applied prior to, during, or after shaving.

A number of problems accompany the use of pre- and post-applied shaving aids. Pre-applied shaving aids can evaporate or can be carried away from the site of application by repeated strokes of the razor. Post-applied shaving aids are not present on the skin during shaving and thus their application may be too late to prevent an unwanted effect. Moreover, the application of both pre-applied and post-applied shaving aids add additional steps to the shaving process.

It is known to incorporate a shaving aid into a razor by mounting a composite including the shaving aid to the razor. For example, Rogers et al., U.S. Pat. No. 5,113,585 describes a composite including a water-insoluble matrix material, a water-soluble shaving aid, and a low molecular weight release enhancing agent. When exposed to water during shaving, the water-soluble shaving aid leaches from the composition onto the skin. The release enhancing agent also dissolves in the water and improves the release of the water-soluble shaving aid from the composite.

SUMMARY OF THE INVENTION

The invention features a shaving unit including a blade and a composite that has a surface for engaging the user's skin adjacent the blade edge. The shaving unit may be of a disposable cartridge type adapted for coupling to and uncoupling from a razor handle or may be integral with a handle so that the complete razor is discarded as a unit when the blade becomes dulled. The blade edge cooperates with skin engaging surfaces to define shaving geometry. The composite includes a water-insoluble polymer, a shaving aid, and a water-swellable polymer. When the composite contacts water during shaving, the water-swellable polymer absorbs water and swells. The swelling causes channels to form in the composite, allowing the shaving aid to be released more readily from the composite onto the skin.

A water-swellable polymer is a polymer which is relatively insoluble (less than 1000 ppm at 22° C.) in water but which can absorb at least 5 times its weight in water. Preferred water-swellable polymers can absorb at least 100 times their weight in water at 22° C. The preferred water-swellable polymers include cross-linked acrylic and methacrylic acid polymers, cross-linked starch-polyacrylate copolymers, cross-linked polyethylene oxide, cross-linked polyacrylamide, and cross-linked sodium carboxy methyl celluloses.

Commercially available polymers sometimes include small quantities of impurities, such as the starting materials used to synthesize the polymers, or uncross-linked polymers. The cross-linked polymers should be at least 99.9% pure when determining whether a particular polymer absorbs a sufficient quantity of water and is sufficiently insoluble in water to qualify as a water-swellable polymer.

A shaving aid is a substance that aids in the shaving process. The shaving aid can be, for example, a lubricant such as polyethylene oxide, polyvinyl pyrrolidone, polyacrylamide, hydroxypropyl cellulose, polyvinyl imidazoline, polyhydroxyethylmethacrylate, and silicone; a beard hair softener; a substance that enhances the healing or stops the bleeding of the skin; an oil that improves the character of the skin such as menthol, eugenol, eucalyptol, safrol, and methyl salicylate; or a rinsing aid. A preferred shaving aid is a water-soluble polymer like polyethylene oxide that functions as a lubricant.

The water-insoluble polymer maintains the general structure of the composite as the shaving aid transfers to the skin. A preferred water-insoluble polymer is polystyrene.

The preferred composites also may include one or more of the water-soluble release enhancers (e.g., polyethylene glycol) described in U.S. Pat. No. 5,113,585, which is hereby incorporated by reference.

Other features and advantages of the invention will be apparent from the description of the preferred embodiment thereof, and from the claims.

DESCRIPTION OF THE PREFERRED EMBODIMENTS

Figure 1:
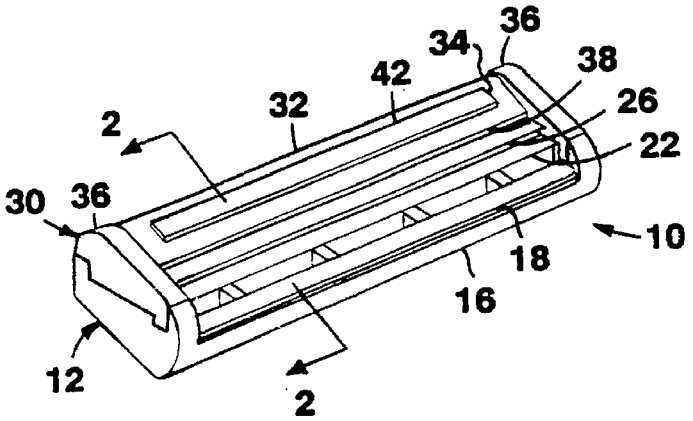
FIG. 1 is a perspective view of a razor unit in accordance with the invention.
Figure 2:
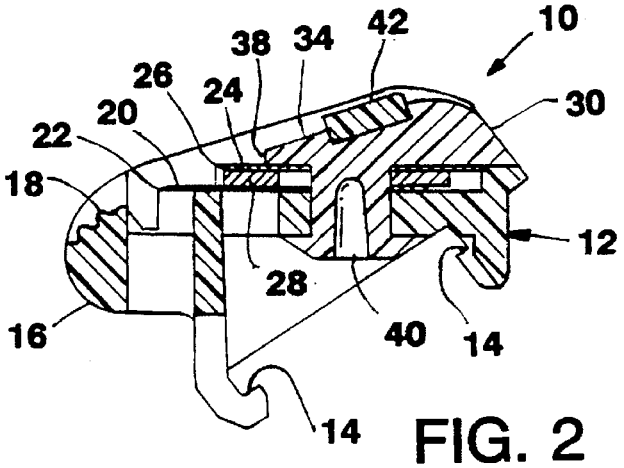
FIG. 2 is a sectional view taken along the line 2—2 of FIG. 1.

The shaving unit 10 shown in FIGS. 1 and 2 includes base or platform member 12 molded of high impact polystyrene that includes integral coupling groove structure 14 for attachment to a razor handle and guard structure 16 that defines a transversely extending forward skin engaging surface 18. On the upper surface of platform 12 are disposed steel leading blade 20 having a sharpened edge 22, steel following blade 24 having sharpened edge 26, and aluminum spacer member 28 that maintains blades 20 and 24 in spaced relation. Cap member 30 is molded of high impact polystyrene and has body portion 32 that defines skin engaging surface 34 that extends transversely between forwardly projecting end walls 36 and has a front edge 38 that is disposed rearwardly of blade edge 26. Integral rivet portions 40 extend downwardly from transversely extending body portion 32 and pass through holes in blades 20 and 24, spacer 28, and platform 12 to secure cap 30, blades 20, 24 and spacer 28 on platform 12. Adhesively affixed to skin engaging surface 34 is composite 42.

Figure 3:
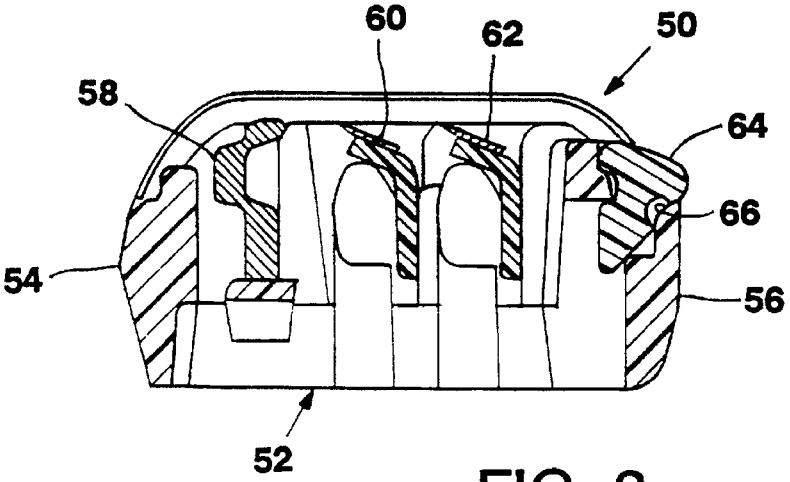
FIG. 3 is a perspective view of another razor unit in accordance with the invention.

The shaving unit 50 shown in FIG. 3 is of the type shown in Jacobson, U.S. Pat. No. 4,586,255 and includes body 52 with front portion 54 and rear portion 56. Resiliently secured in body 52 are guard member 58, leading blade unit 60 and trailing blade unit 62. A composite in the form of elongated insert member 64 is fractionally locked in opening 66 of rear portion 56.

The preferred composites include a water-insoluble polymer, a water-soluble lubricant as a shaving aid, a low molecular weight water-soluble release enhancing agent, a water-swellable polymer, and optionally small quantities of a colorant and an antioxidant.

Suitable water-insoluble polymers include polyethylene, polypropylene, polystyrene, and polyacetal. The more preferred water-insoluble resin is polystyrene, which is available from BASF Corporation and Dow Chemical Company.

The composite should contain a sufficient quantity of the polymer that the composite will have adequate mechanical strength, both as initially produced and after a significant amount of the water-soluble composite components have leached out. The composite preferably includes 10–60 percent by weight, and more preferably 20–40 percent by weight, of the water-insoluble polymer.

The preferred water-soluble lubricants are the high molecular weight polyethylene oxides known generally as "Polyox" (available from Union Carbide Corporation) or "Alkox" (available from Meisei Chemical Works, Kyoto, Japan). The preferred high molecular weight polyethylene oxides have a molecular weight of 100,000–6,000,000; more preferably, they have a molecular weight of 300,000–5,000,000. A sufficient quantity of the lubricant should be included in the composite to provide effective shaving assistance over the effective life of the blade. The composite preferably includes 20–90 percent by weight, and more preferably 50–80 percent by weight, of the water-soluble lubricant.

The preferred water-soluble low molecular weight release enhancing agents are polyethylene glycols. The molecular weight of the release enhancing agent preferably is much lower than the molecular weight of the water soluble lubricant; as a result, the release enhancing agent generally will dissolve much more quickly than the lubricant. The composite preferably contains 0–20%, and more preferably 5–10%, of the release enhancing agent by weight.

Examples of water-swellable polymers include water-absorbing acrylics such as Salsorb 84, Salsorb 88, and Salsorb 90, all of which are available from Allied Colloids Corporation; cross-linked starch sodium polyacrylate copolymers such as SanWet COS-960, SanWet COS-915, and SanWet COS-930, all of which are available from the Hoechst Celanese Corporation, and Waterlock A-180, which is available from Grain Processing Corporation; hydroxypropylmethylcelluloses such as Methocel, which is available from Dow Chemical Corporation; polyacrylic acids such as Carbopol 940, which is available from B.F. Goodrich Company; microcrystalline celluloses such as Avicel, which is available from FMC Corporation; chitosan pyrrolidone carboxylic acids such as Kytamer PC, which is available from Amerchol Corporation; acrylic acid/acrylonitrogen copolymers such as Hypan-SA-100H, which is available from Kingston Hydrogels Corporation; cross-linked potassium acrylates such as Liqua-Gel, which is available from Miller Chem. & Fertilizer Corporation; carboxymethylcelluloses such as Aquasorb B-315 (Na salt) and AQU-D3236 (Al/Na salt), both of which are available from Aqualen Corporation; and cross-linked polyacrylic acid polyalcohol grafted copolymers such as FAVOR SAB 800, which is available from Stockhausen Company. Two further examples of water-swellable polymers are Ultrasponge (available from MicroVesicular Systems Inc.), and Costech (available from Costech Corporation). The more preferred water-swellable polymers are the SanWets and Salsorbs.

A sufficient quantity of the water-swellable polymer should be included in the composite such that, when the composite is contacted with water, the swelling of the polymer cause an increase in the release of the shaving aid from the composite. The composite preferably includes 0.2–50 percent, more preferably 3–15 percent, and most preferably 4–8 percent, of the water-swellable polymer by weight.

The composite can be formed by extrusion, injection molding, or in situ molding on a razor cap. Extrusion is the preferred method since it is a simpler process. This takes place in an environment where the humidity is controlled to minimize moisture absorption in the blend.

EXAMPLE 1

Insert members are formed of a blend of 38% by weight Polyox Coagulant grade polyethylene oxide (5,000,000 molecular weight polyethylene oxide) and 25% Polyox WSR-N750 (300,000 molecular weight polyethylene oxide), 24% by weight of water-insoluble polystyrene, 5% by weight of water-soluble polyethylene glycol (4500 molecular weight) and 5% by weight of dried Salsorb 88. The Salsorb has a particle size range of 44–74 microns. The blend also includes 2.7% by weight color concentrate and 0.3% by weight antioxidant. The blend is extruded through an extruder with a barrel pressure of about 2500 psi and a temperature of about 185° C. and a die pressure of about 1200 psi and a temperature of about 190° C. to form an extruded strip member of cross-sectional shape indicated in FIG. 3. Members 64 are sliced from the extruded strip and secured in openings 66 of shaving units 50. A strip of cross-sectional shape indicated in FIG. 2 is similarly extruded and sliced into members 42 that are adhesively secured in a recess in cap member 30. The resulting extruded members are sturdy and have attractive appearance, and the resulting cartridges possess good overall shaving performance.

EXAMPLE 2

Insert members 64 are formed of a blend of 40% by weight Polyox Coagulant, and 27% by weight Polyox WSR-N750, 24% by weight of water-insoluble polystyrene, 2% by weight of glycerin, and 5% by weight of dried Salsorb 84 (with a particle size of 44–74 microns). The blend also includes 1.7% by weight color concentrate and 0.3% by weight antioxidant. The blend is extruded through an extruder with a barrel pressure of about 2500 psi and a temperature of about 185° C. and a die pressure of about 1200 psi and a temperature of about 190° C. to form an extruded stip member of cross-sectional shape indicated in FIG. 3. Members 64 are sliced from the extruded strip and secured in openings 66 of shaving units 50. The resulting extruded members are sturdy and have attractive appearance and the resulting cartridges possess good overall shaving performance.

EXAMPLE 3

Insert members are formed of a blend of 38% by weight Polyox Coagulant grade and 25% by weight Polyox WSR-N750, 25% by weight of water-insoluble polystyrene, 5% by weight of water-soluble polyethylene glycol (4,500 molecular weight), and 5% by weight of dried SanWet 915. The SanWet has a particle size range of 44–74 microns. The blend includes 1.7% by weight color concentrate and 0.3% by weight antioxidant. The blend is extruded through an extruder with a barrel pressure of 2500 psi and a temperature of about 185° C. and a die pressure of about 1200 psi and a temperature of about 190° C. to form an extruded strip member of cross-sectional shape indicated in FIG. 3. Strips are sliced from the extruded strip and secured in openings 66 of shaving units 50. The resulting extruded members are sturdy and have attractive appearance and the resulting cartridges possess good overall shaving performance.

EXAMPLE 4

Insert members are formed of a blend of 38% by weight Polyox Coagulant grade and 16% by weight Polyox WSR- N750, 30% by weight of water-insoluble polystyrene, 10% by weight of water-soluble polyethylene glycol (4,500 molecular weight), and 3% by weight of Salsorb 90. The Salsorb has a particle size range of 44–74 microns. The blend includes 2.8% by weight color concentrate and 0.2% by weight antioxidant.

EXAMPLE 5

Insert members are formed of a blend of 42% by weight Polyox Coagulant grade and 28% by weight Polyox WSR-N750, 22% by weight of water-insoluble polystyrene, and 6% by weight of dried SanWet 960. The SanWet has a particle size range of 44–74 microns. The blend includes 1.8% by weight color concentrate and 0.2% by weight antioxidant.

EXAMPLE 6

Insert members are formed of a blend of 35% by weight Polyox Coagulant grade and 24% by weight Polyox WSR-N750, 24% by weight of water-insoluble polystyrene, 5% by weight of water-soluble polyethylene glycol (4,500 molecular weight), and 10% by weight of dried Salsorb 88. The Salsorb has a particle size range of 44–74 microns. The blend includes 1.8% by weight color concentrate and 0.2% by weight antioxidant.

Other embodiments are within the claims. For example, the composites of the invention can be used with other razors, such as those described in U.S. Pat. Nos. 5,056,222 and 4,624,051, which are hereby incorporated by reference.

We claim:

1. A shaving system for wet shaving comprising support structure supporting a blade member and defining an external skin engaging portion adjacent to said blade member, said skin engaging portion including a composite comprising a water-insoluble polymer, a lubricant, and a water-swellable polymer that can absorb at least five times its weight in water at 22° C. and has a solubility in water of less than 1000 ppm at 22° C.

2. The shaving system of claim 1, wherein said lubricant is a water-soluble polymer.

3. The shaving system of claim 2, wherein said water-soluble polymer is polyethylene oxide.

4. The shaving system of claim 3, wherein said polyethylene oxide comprises polyethylene oxide having a molecular weight of about 300,000 and polyethylene oxide having a molecular weight of about 5,000,000.

5. The shaving system of claim 1, wherein said water-insoluble polymer comprises polystyrene.

6. The shaving system of claim 1, wherein said water-swellable polymer comprises a cross-linked acrylic acid polymer or copolymer.

7. The shaving system of claim 1, wherein said water-swellable polymer comprises a cross-linked starch-polyacrylate copolymer.

8. The shaving system of claim 1, wherein said water-swellable polymer comprises a cross-linked polyethylene oxide.

9. The shaving system of claim 1, wherein said water-swellable polymer comprises a cross-linked polyacrylamide.

10. The shaving system of claim 1, wherein said water-swellable polymer can absorb at least 100 times its weight in water at 22° C.

11. The shaving system of claim 1, wherein said composite includes 0.2 percent to 50 percent by weight of said water-swellable polymer.

12. The shaving system of claim 1, wherein said composite includes about 3 percent to about 15 percent by weight of said water-swellable polymer.

13. The shaving system of claim 1, wherein said composite includes between 10% and 60% by weight of said water-insoluble polymer, between 20% and 90% by weight of said lubricant, and between 0.2% and 50% by weight of said water-swellable polymer.

14. The shaving system of claim 1, wherein said composite includes between 20% and 40% by weight of said water-insoluble polymer, between 50% and 80% by weight of said lubricant, and between 3% and 15% by weight of said water-swellable polymer.

15. The shaving system of claim 14, wherein said water-insoluble polymer comprises polystyrene, said lubricant comprises polyethylene oxide, and said water-swellable polymer is selected from a group consisting of acrylic polymers and starch-polyacrylate copolymers.

16. A method of shaving, comprising contacting skin in the presence of water with a razor so as to sever hair on said skin, said razor having a blade and a skin engaging composite comprising a water insoluble polymer, a lubricant, and a water-swellable polymer, said water-swellable polymer having a solubility in water of less than 1000 ppm at 22° C. and absorbing at least five times its weight in water at 22° C., wherein said contacting step includes the steps of contacting said skin engaging composite of said razor with said water to cause said water-swellable polymer to swell, and contacting said skin with said composite of said razor to transfer said lubricant from said composite onto said skin.

17. The method of claim 16, wherein said lubricant is a water-soluble polymer.

18. The method of claim 17, wherein said water-soluble polymer is polyethylene oxide.

19. The method of claim 16, wherein said water-insoluble polymer comprises polystyrene.

20. The method of claim 16, wherein said water-swellable polymer comprises a cross-linked acrylic polymer or copolymer.

21. The shaving system of claim 16, wherein said water-swellable polymer comprises a cross-linked starch-polyacrylate copolymer.

22. The method of claim 16, wherein said water-swellable polymer comprises a cross-linked polyethylene oxide.

23. The method of claim 16, wherein said water-swellable polymer comprises a cross-linked polyacrylamide.

24. The method of claim 16, wherein said water-swellable polymer can absorb at least 100 times its weight in water at 22° C.

25. The method of claim 16, wherein said composite includes 0.2 percent to 50 percent by weight of said water-swellable polymer.

26. The method of claim 16, wherein said composite includes about 3 percent to about 15 percent by weight of said water-swellable polymer.

* * * * *